US009243431B1

(12) United States Patent
DeLeon

(10) Patent No.: US 9,243,431 B1
(45) Date of Patent: Jan. 26, 2016

(54) LOCK-OUT TAG-OUT BAR SYSTEM

(71) Applicant: Daniel DeLeon, Houston, TX (US)

(72) Inventor: Daniel DeLeon, Houston, TX (US)

( * ) Notice: Subject to any disclaimer, the term of this patent is extended or adjusted under 35 U.S.C. 154(b) by 0 days.

(21) Appl. No.: 14/485,717

(22) Filed: Sep. 13, 2014

Related U.S. Application Data

(60) Provisional application No. 61/877,903, filed on Sep. 13, 2013.

(51) Int. Cl.
*E05C 19/18* (2006.01)
*E05C 19/00* (2006.01)
*E05B 65/08* (2006.01)

(52) U.S. Cl.
CPC ..... *E05C 19/003* (2013.01); *E05C 19/005* (2013.01); *E05B 65/0888* (2013.01)

(58) Field of Classification Search
CPC ... E05C 19/003; E05C 19/004; E05C 19/005; E05C 19/186; E05C 19/188; E05B 65/0888; E05B 65/44; C10B 25/12; A47B 67/02; B65B 5/04; H02B 1/06; H02B 1/066; Y10T 292/37; Y10T 29/49963; Y10T 29/49947; Y10T 29/49966
USPC ..... 70/93, 94, 101, 135, DIG. 12, DIG. 30, 70/DIG. 64, DIG. 65, DIG. 66, 14; 292/205, 292/259 R, 259 A, 260, 262, 338, 339, 292/DIG. 15; 200/43.14, 43.22; 312/216, 312/245
See application file for complete search history.

(56) References Cited

U.S. PATENT DOCUMENTS

| | | | | | |
|---|---|---|---|---|---|
| 546,164 | A * | 9/1895 | Knight | 292/259 R |
| 669,295 | A * | 3/1901 | Wendel | 70/25 |
| 677,432 | A * | 7/1901 | Biehl | 292/210 |
| 868,234 | A * | 10/1907 | Tyden | 292/285 |
| 994,789 | A * | 6/1911 | Repass | 292/67 |
| 1,312,931 | A * | 8/1919 | Tenny | 292/205 |
| 1,379,959 | A * | 5/1921 | Brodowski | 292/262 |
| 1,479,117 | A * | 1/1924 | Trimmer | 292/205 |
| 1,483,316 | A * | 2/1924 | Seelinger | 16/82 |
| 1,514,114 | A * | 11/1924 | Wakefield | 292/281 |
| 1,637,655 | A * | 8/1927 | Prisley | 292/265 |
| 2,130,216 | A * | 9/1938 | Zaninovich | 292/259 R |
| 3,280,606 | A * | 10/1966 | Howard et al. | 292/259 R |
| 3,592,497 | A * | 7/1971 | Logan, Jr. | 292/259 R |
| 3,608,940 | A * | 9/1971 | Mueller | 292/262 |
| 3,665,736 | A * | 5/1972 | Wilson | 70/78 |
| 4,067,598 | A * | 1/1978 | Mansour | 292/259 R |
| 4,601,503 | A * | 7/1986 | Wicks, Sr. | 292/259 R |
| 4,741,564 | A * | 5/1988 | Alford | 292/285 |
| 4,772,053 | A * | 9/1988 | Oxley | 292/259 R |
| 5,282,656 | A * | 2/1994 | Fizer | 292/259 R |
| 5,419,165 | A * | 5/1995 | Perkins | 70/14 |
| 5,669,640 | A * | 9/1997 | Ryan | 292/259 R |
| 6,481,252 | B2 * | 11/2002 | Calle et al. | 70/94 |
| 7,026,932 | B2 | 4/2006 | Loudon | |
| 7,148,435 | B2 | 12/2006 | Lau et al. | |

(Continued)

*Primary Examiner* — Lloyd Gall
(74) *Attorney, Agent, or Firm* — RG Patent Consulting, LLC; Rachel Gilboy

(57) ABSTRACT

An apparatus for securing electrical panels from unauthorized persons by using a lock-out bar extending the width of an electrical panel. The lock-out bar is secured to a panel-right-side-L-bracket via a pivot-pin allowing the lock-out-bar to be rotated between a horizontal position to secure an electrical panel door and a vertical position allowing the electrical panel door to be opened. The lock-out-bar, when in the horizontal position, is locked in place to a panel-left-side-L-bracket.

7 Claims, 5 Drawing Sheets

(56) References Cited

U.S. PATENT DOCUMENTS 7,661,733 B1 * 2/2010 Angel ..... 292/259 R
7,681,421 B2 3/2010 Cannon
7,850,013 B1 * 12/2010 Kramer et al. ..... 211/4
2007/0205703 A1 * 9/2007 McLuckie et al. ..... 312/216
2009/0217713 A1 * 9/2009 Loughlin et al. ..... 70/53
2012/0240642 A1 * 9/2012 Senn ..... 70/101
2012/0326457 A1 * 12/2012 Mead ..... 292/259 R
2013/0219828 A1 * 8/2013 Canaday et al. ..... 53/438

* cited by examiner

LOCK-OUT TAG-OUT BAR SYSTEM

CROSS-REFERENCE TO RELATED APPLICATION

The present application is related to and claims priority from prior provisional application Ser. No. 61/877,903, filed Sep. 13, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of lock-out security devices and more specifically relates to a lock-out tag-out bar system.

2. Description of the Related Art

Electrical panels, also referred to as circuit breaker panels and fuse boxes, are fixtures on virtually every building using electrical energy. These panels contain electric wiring and circuit breakers that can present a deadly danger if not handled properly. Homeowners, business owners, and every other responsible property owner or manager is well aware that these dangerous panels need to be protected from children. Additionally, vandals may want to access these panels to disconnect electric power from the building so that the building is more penetrable for them.

Vacant buildings, in particular, can be tempting to unauthorized persons who may wish to tap into a source of free electricity. Professional electricians want to protect their work and want to feel secure that the building they are servicing won't experience electrical problems caused by an unauthorized person accessing the electrical panel. Their work needs to be kept safe and secure. There is a need to solve these problems.

Various attempts have been made to solve the above-mentioned problems such as those found in U.S. Pat. No. 7,148,435 to Allen K. Lau, et al; U.S. Pat. No. 7,026,932 to Gary J. Loudon; and U.S. Pat. No. 7,681,421 to Richard Michael Cannon. This art is representative of lockout security devices. None of the above inventions and patents, taken either singly or in combination, is seen to describe the invention as claimed.

Ideally, a lock-out tag-out bar system should provide security for an electrical panel such that unauthorized persons are not able to gain access to the panel, and, yet would operate reliably and be manufactured at a modest expense. Thus, a need exists for a reliable lock-out tag-out bar system to avoid the above-mentioned problems.

BRIEF SUMMARY OF THE INVENTION

In view of the foregoing disadvantages inherent in the known lockout security device art, the present invention provides a novel lock-out tag-out bar system. The general purpose of the present invention, which will be described subsequently in greater detail, is to provide a means for securing electrical panels from unauthorized persons.

A lock-out tag-out bar system is disclosed in a preferred embodiment herein comprising: a lock-out-tag-out-bar-assembly as structured and arranged comprising a lock-out-bar having a first-end and a second-end, a pivot-pin, a panel-right-side-L-bracket, and a panel-left-side-L-bracket.

The lock-out-bar preferably comprises a flat-steel-bar having a length of approximately twenty-four inches able to span the width of a standard electrical-panel and a width and a depth providing a suitable mass able to withstand attempts of vandalism to gain access to the electrical-panel. The first-end of the lock-out-bar comprises a bar-first-end-hole and the second-end of the lock-out-bar comprises a bar-second-end-hole.

The panel-right-side-L-bracket preferably comprises a right-bracket-hole and a plurality of right-bracket-fastener-holes. The right-bracket-fastener-holes are useful for fixedly attaching the panel-right-side-L-bracket to a panel-right-side via a plurality of fasteners comprising carriage-bolts having smooth heads able to prevent tampering.

Each of the carriage-bolts is inserted through each of the plurality of right-bracket-fastener-holes of the panel-right-side-L-bracket and through each of a plurality of panel-holes of the panel-right-side to fixedly secure the panel-right-side-L-bracket to the panel-right-side via a nut and a washer fixedly attached to each of the carriage-bolts. The right-bracket-hole of the panel-right-side-L-bracket and the bar-first-end-hole of the first-end of the lock-out-bar comprise a diameter sufficient to hold the diameter of the pivot-pin.

The panel-left-side-L-bracket preferably comprises a left-bracket-hole and a plurality of left-bracket-fastener-holes. The left-bracket-fastener-holes are useful for fixedly attaching the panel-left-side-L-bracket to a panel-left-side via the plurality of fasteners comprising carriage-bolts having smooth heads able to prevent tampering.

In a preferred embodiment each of the carriage-bolts is inserted through each of the plurality of left-bracket-fastener-holes of the panel-left-side-L-bracket and through each of a plurality of panel-holes of the panel-left-side to fixedly secure the panel-left-side-L-bracket to the panel-left-side via a nut and a washer fixedly attached to each of the carriage-bolts. The left-bracket-hole of the panel-left-side-L-bracket and the bar-second-end-hole of the second-end of the lock-out-bar each comprise a diameter of approximately three-eighths inch sufficient to hold a shank of the locking-means comprising a padlock requiring a key to gain access to the electrical-panel.

The pivot-pin, comprising a lockable-mechanism able to prevent vandals from disconnecting the lock-out-bar from the panel-right-side-L-bracket, is able to couple the panel-right-side-L-bracket to the first-end of the lock-out-bar via the right-bracket-hole on the panel-right-side-L-bracket and the bar-first-end-hole on the first-end of the lock-out-bar.

The pivot-pin is lockably placed through an alignment of the right-bracket-hole of the panel-right-side-L-bracket and the bar-first-end-hole on the first-end of the lock-out-bar. When secured via the pivot-pin, the lock-out-bar is able to be manipulated via the pivot-pin between a horizontal position to secure an electrical-panel-door in a closed condition and a vertical position allowing the electrical-panel-door to be in an open position, thus permitting access to the electrical-panel.

The second-end of the lock-out-bar is removably coupled to the panel-left-side-L-bracket via placing the placing the shank of the padlock through an alignment of the bar-second-end-hole of the second-end of the lock-out-bar and the left-bracket-hole of the panel-left-side-L-bracket. The lock-out-bar is able to prevent the electrical-panel-door from unauthorized use when in the horizontal-position and freedom of access when in the vertical position.

The electrical-panel comprises a tag-out for use by a certified electrician to certify the date the lock-out-bar was secured to the electrical-panel. The tag-out comprises a "do not disturb" tag to indicate the date of last access to the electrical-panel and stipulating who is authorized to open the electrical-panel.

When in use, a user is able secure an electrical-panel-door via pivoting the lock-out-bar to a horizontal position via the pivot-pin and removably coupling the lock-out-bar to the panel-left-side-L-bracket via placing the padlock shank through an alignment of the bar-second-end-hole on the second-end of the lock-out-bar and the left-bracket-hole on the panel-left-side-L-bracket and then lock the padlock. The user is then able to place the tag-out on the electrical-panel to indicate the date of securing the electrical-panel and stipulating who is authorized to open the electrical-panel at a future date.

The present invention holds significant improvements and serves as a lock-out tag-out bar system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, lock-out tag-out bar system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a lockout security device and more particularly to a lock-out tag-out bar system as used to improve the ability to secure electrical panels from access to unauthorized persons.

Generally speaking, the lock-out tag-out bar system is used by building owners and electricians to secure an electrical-panel located on an outside wall of a building. The electrical-panel, if not properly secured, is an invitation to unauthorized users and curious children. An electrician is able to unlock a lock-out-bar comprising a flat steel bar from an L-shaped bracket located on the left side of the electrical panel and manipulate the lock-out-bar to a vertical position to gain access to the interior of the electrical-panel. The lock-out-bar is able to be manipulated between a horizontal and a vertical position via a pivot-pin which fixedly holds one end of the lock-out-bar to an L-shaped bracket located on the right side of the electrical panel.

Figure 1:
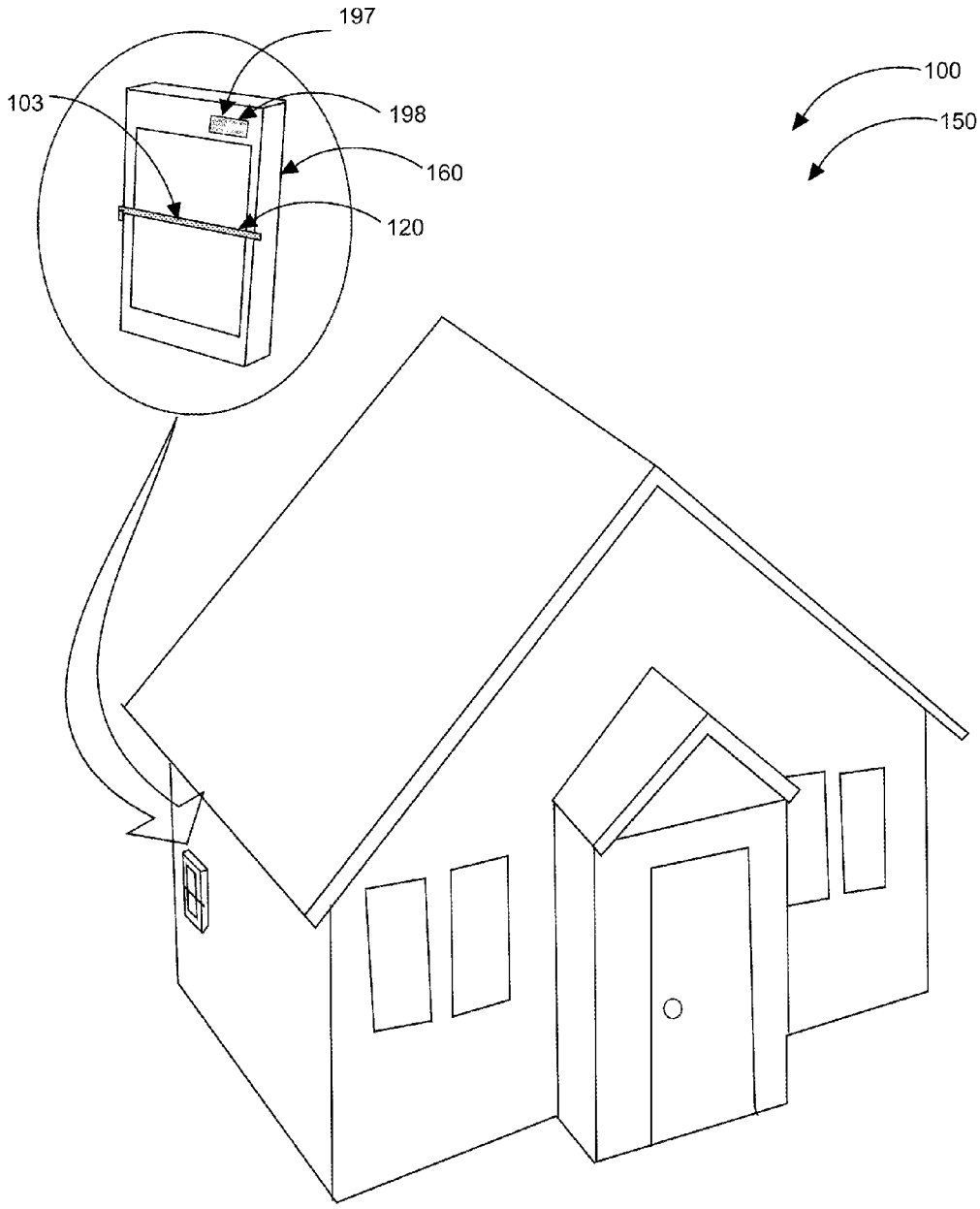
FIG. 1 shows a perspective view illustrating a lock-out tag-out bar system in an in use condition according to an embodiment of the present invention.

Referring to the drawings by numerals of reference there is shown in FIG. 1, a perspective view illustrating lock-out tag-out bar system 100 in an in use condition 150 according to an embodiment of the present invention.

Lock-out tag-out bar system 100 comprises: lock-out-tag-out-bar-assembly 110 as structured and arranged comprising lock-out-bar 120 having first-end 130 and second-end 140, pivot-pin 160, panel-right-side-L-bracket 170, and panel-left-side-L-bracket 180.

When in use, a user is able secure electrical-panel-door 192 via pivoting lock-out-bar 120 to horizontal position 102 via pivot-pin 160 and removably coupling lock-out-bar 120 to panel-left-side-L-bracket 180 via placing a shank of padlock 108 through an alignment of bar-second-end-hole 142 on second-end 140 of lock-out-bar 120 and left-bracket-hole 182 on panel-left-side-L-bracket 180.

Electrical-panel 190 comprises tag-out 197 for use by a certified electrician to certify the date lock-out-bar 120 was secured to electrical-panel 190. Tag-out 197 comprises "do not disturb" message 198 to indicate the date of last access to electrical-panel 190 and stipulating whom is authorized to open electrical-panel-door 192. The user is able to place tag-out 197 on electrical-panel 190 to indicate who is authorized to open electrical-panel-door 192 at a future date.

Figure 2:
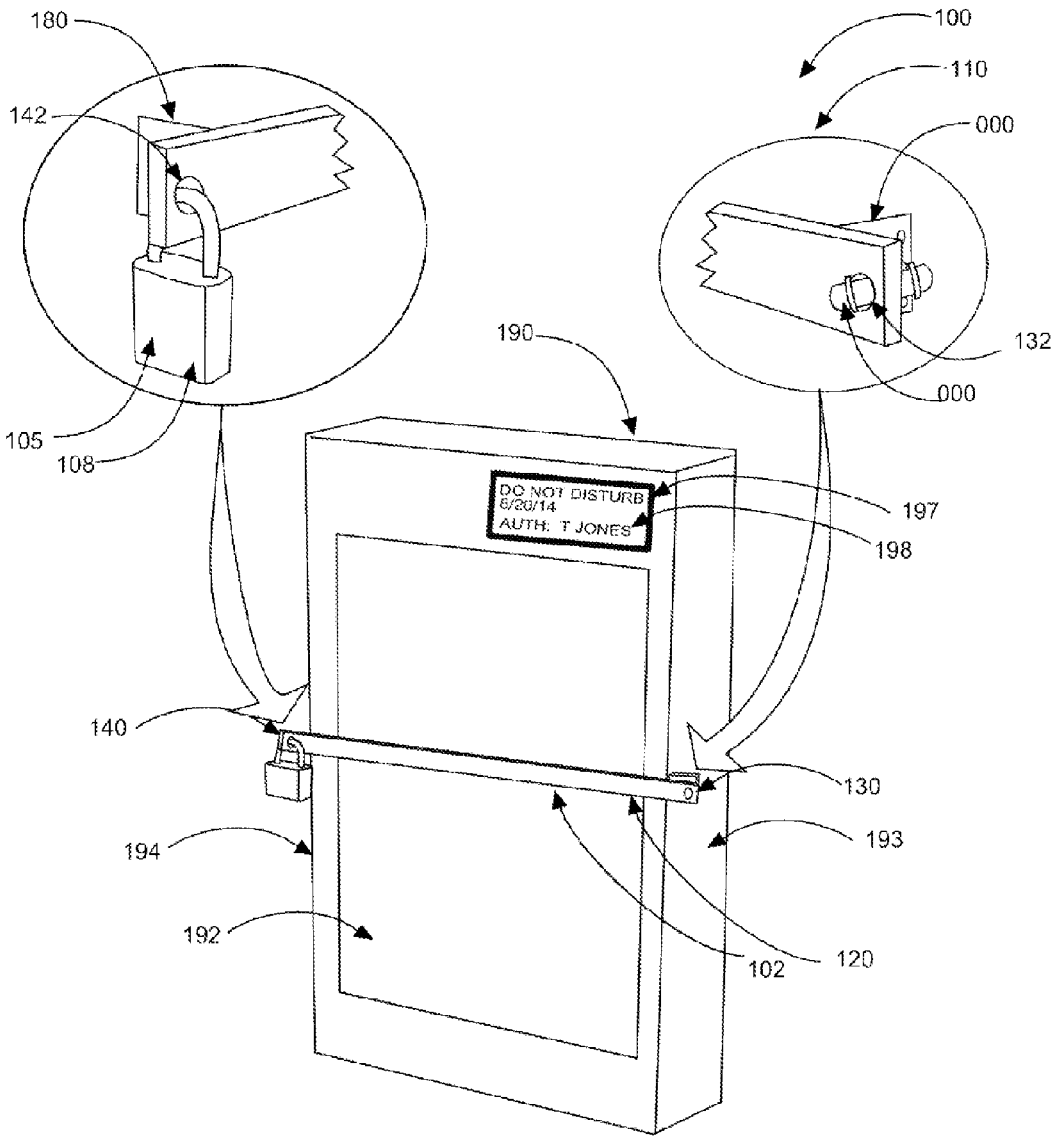
FIG. 2 is a perspective view illustrating a secured electrical-panel according to an embodiment of the present invention of FIG. 1.

Referring now to FIG. 2, a perspective view illustrating a secured electrical-panel 190 according to an embodiment of the present invention of FIG. 1

Lock-out-bar 120 preferably comprises a flat-steel-bar having a length of approximately twenty-four inches able to span the width of standard electrical-panel 190 and a width and a depth providing a suitable mass able to withstand attempts of vandalism to gain access to electrical-panel 190. First-end 130 of lock-out-bar 120 comprises bar-first-end-hole 132 and second-end 140 of lock-out-bar 120 comprises bar-second-end-hole 142. In alternate embodiments lock-out-bar 120 may comprise a flat-steel-bar or other suitable material having a length longer or shorter than twenty-four inches to match the width of whatever electrical-panel 190 is to be secured.

Panel-right-side-L-bracket 170 preferably comprises right-bracket-hole 172 and plurality of right-bracket-fastener-holes 174 useful for fixedly attaching panel-right-side-L-bracket 170 to a plurality of pre-drilled panel-holes prepared on panel-right-side 193 via plurality of fasteners 155 comprising carriage-bolts having smooth heads able to prevent tampering. Other types of fasteners 155 may be used as desired by the user to attach panel-right-side-L-bracket 170 to panel-right-side 193.

Each of plurality of fasteners 155 is inserted through each of plurality of right-bracket-fastener-holes 174 of panel-right-side-L-bracket 170 and through each of plurality of pre-drilled panel-holes on panel-right-side 193 to fixedly secure panel-right-side-L-bracket 170 to panel-right-side 193 via nut 156 and washer 157 removably attached to each of plurality of fasteners 155. Right-bracket-hole 172 of panel-right-side-L-bracket 170 and bar-first-end-hole 132 of first-end 130 of lock-out-bar 120 comprise a diameter sufficient to hold the diameter of pivot-pin 160. Alternate fastening means may be used.

Panel-left-side-L-bracket 180 preferably comprises left-bracket-hole 182 and plurality of left-bracket-fastener-holes 184 useful for fixedly attaching panel-left-side-L-bracket 180 to a plurality of pre-drilled panel-holes prepared on panel-left-side 194 via plurality of fasteners 155 comprising carriage-bolts having smooth heads able to prevent tampering. Other types of fasteners 155 may be used as desired by the user to attach panel-left-side-L-bracket 180 to panel-left-side 194.

Each of plurality of fasteners 155 is inserted through each of plurality of left-bracket-fastener-holes 184 of panel-left-side-L-bracket 180 and through each of plurality of pre-drilled panel-holes on panel-left-side 194 via nut 156 and washer 157 removably attached to each of plurality of fasteners 155. Left-bracket-hole 182 of panel-left-side-L-bracket 180 and bar-second-end-hole 142 of second-end 140 of lock-out-bar 120 each comprise a diameter of approximately three-eighths inch sufficient to hold a shank of locking-means 105 comprising padlock 108 requiring key 109 to gain access to electrical-panel 190. In an alternate embodiment, locking-means 105 comprises a combination-lock requiring authorized users to have a combination to the combination-lock to access electrical-panel.

Figure 3:
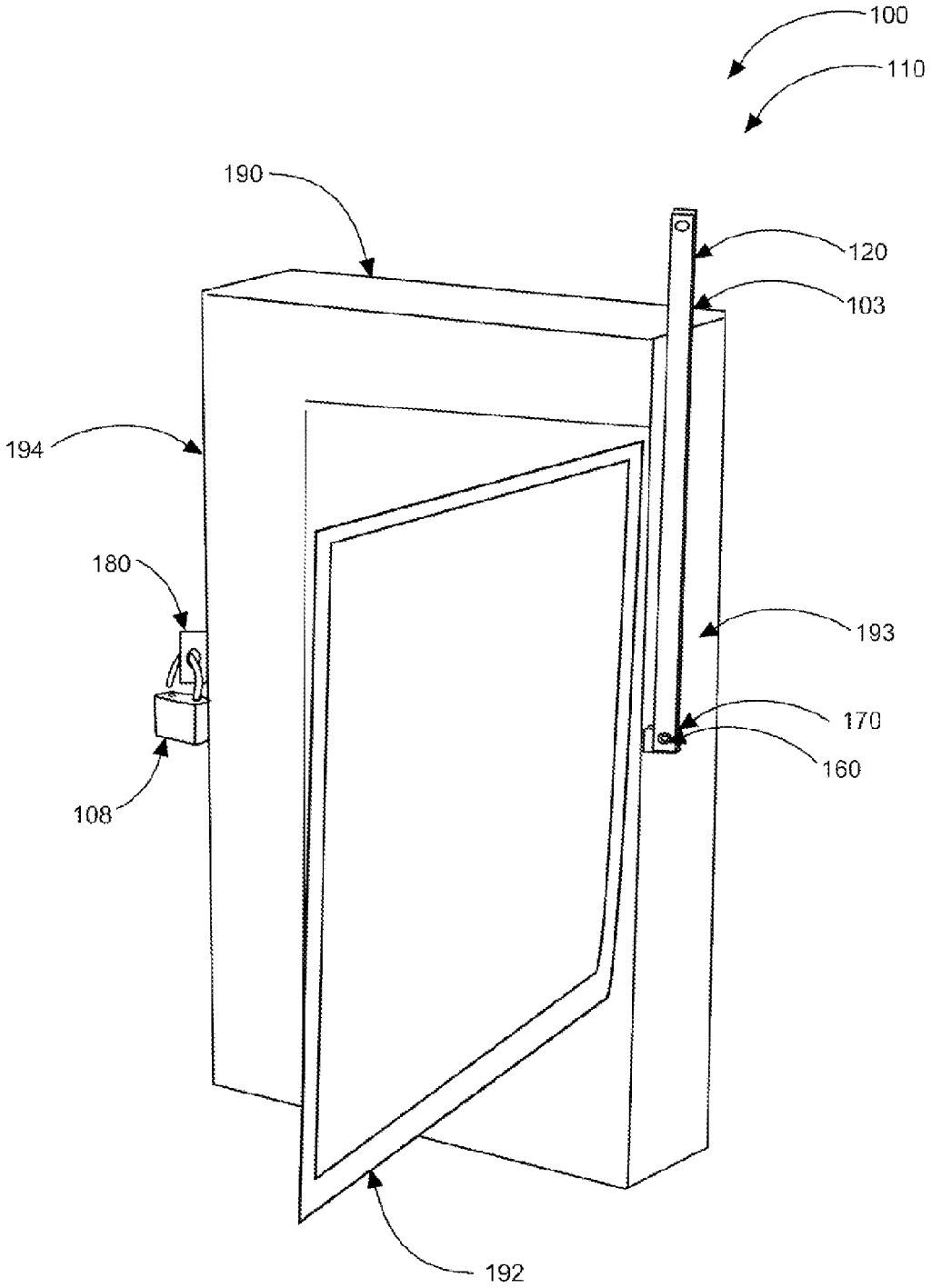
FIG. 3 is a perspective view illustrating an open electrical-panel according to an embodiment of the present invention of FIG. 1.

Referring now to FIG. 3, a perspective view illustrating an opened electrical-panel 190 according to an embodiment of the present invention of FIG. 1.

Pivot-pin 160, preferably comprising a lockable-mechanism able to prevent vandals from disconnecting lock-out-bar 120 from panel-right-side-L-bracket 170, is able to couple panel-right-side-L-bracket 170 to first-end 130 of lock-out-bar 120 via right-bracket-hole 172 on panel-right-side-L-bracket 170 and bar-first-end-hole 132 on first-end 130 of lock-out-bar 120. In alternate embodiments, other types of pivot-pin 160 such as a positive lock pin, clevis pins and cotter pins may be used as desired depending on the level of security desired.

Pivot-pin 160 is placed through an alignment of right-bracket-hole 172 of panel-right-side-L-bracket 170 and bar-first-end-hole 132 on first-end 130 of lock-out-bar 120. When secured via pivot-pin 160, lock-out-bar 120 is able to be manipulated via pivot-pin 160 between horizontal position 102 to secure electrical-panel-door 192 in a closed condition and vertical position 103 allowing electrical-panel-door 192 to be in an open position, thus permitting access to electrical-panel 190.

Second-end 140 of lock-out-bar 120 is removably coupled to panel-left-side-L-bracket 180 via placing shank of padlock 108 through an alignment of bar-second-end-hole 142 of second-end 140 of lock-out-bar 120 and left-bracket-hole 182 of panel-left-side-L-bracket 180. Lock-out-bar 120 is able to prevent electrical-panel-door 192 from being opened by an unauthorized user when in horizontal-position 102 and freedom of access when in vertical position 103.

Figure 4:
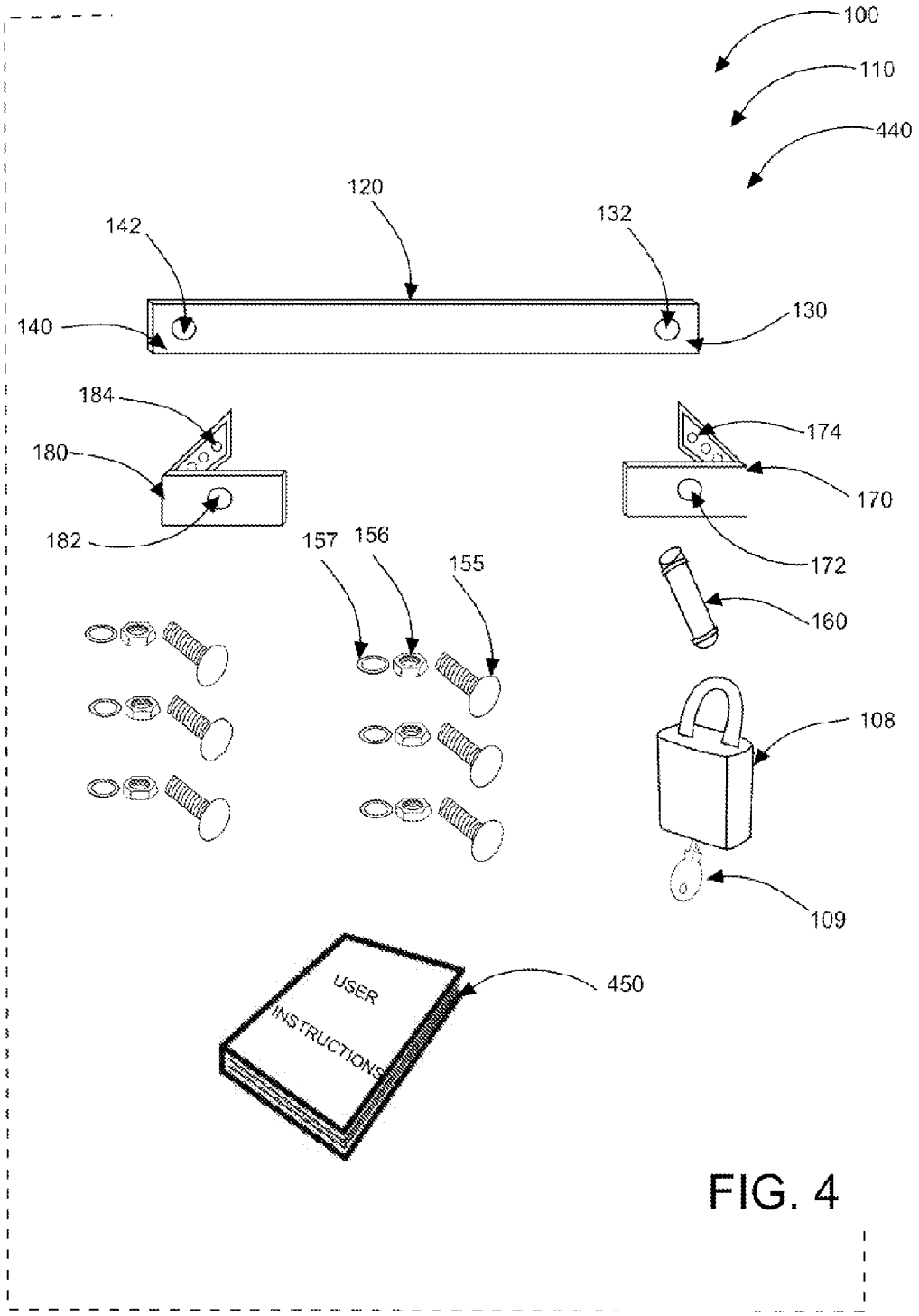
FIG. 4 is a perspective view illustrating a kit for a lock-out tag-out bar system according to an embodiment of the present invention of FIG. 1.

Referring now to FIG. 4, a perspective view illustrating a kit for lock-out tag-out bar system 100 according to an embodiment of the present invention of FIG. 1.

Lock-out tag-out bar system 100 may be sold as kit 440 comprising the following parts: at least one lock-out-bar 120 having first-end 130 and second-end 140; at least one pivot-pin 160; at least one panel-right-side-L-bracket 170; at least one panel-left-side-L-bracket 180; at least one locking-means 105 comprising padlock 108 with key 109; a plurality of fasteners 155, nuts 156 and washers 157; and at least one set of user instructions 450. The kit has instructions such that functional relationships are detailed in relation to the structure of the invention (such that the invention can be used, maintained, or the like in a preferred manner). Lock-out tag-out bar system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different fastening/securing means and combinations, parts may be sold separately, etc., may be sufficient.

Figure 5:
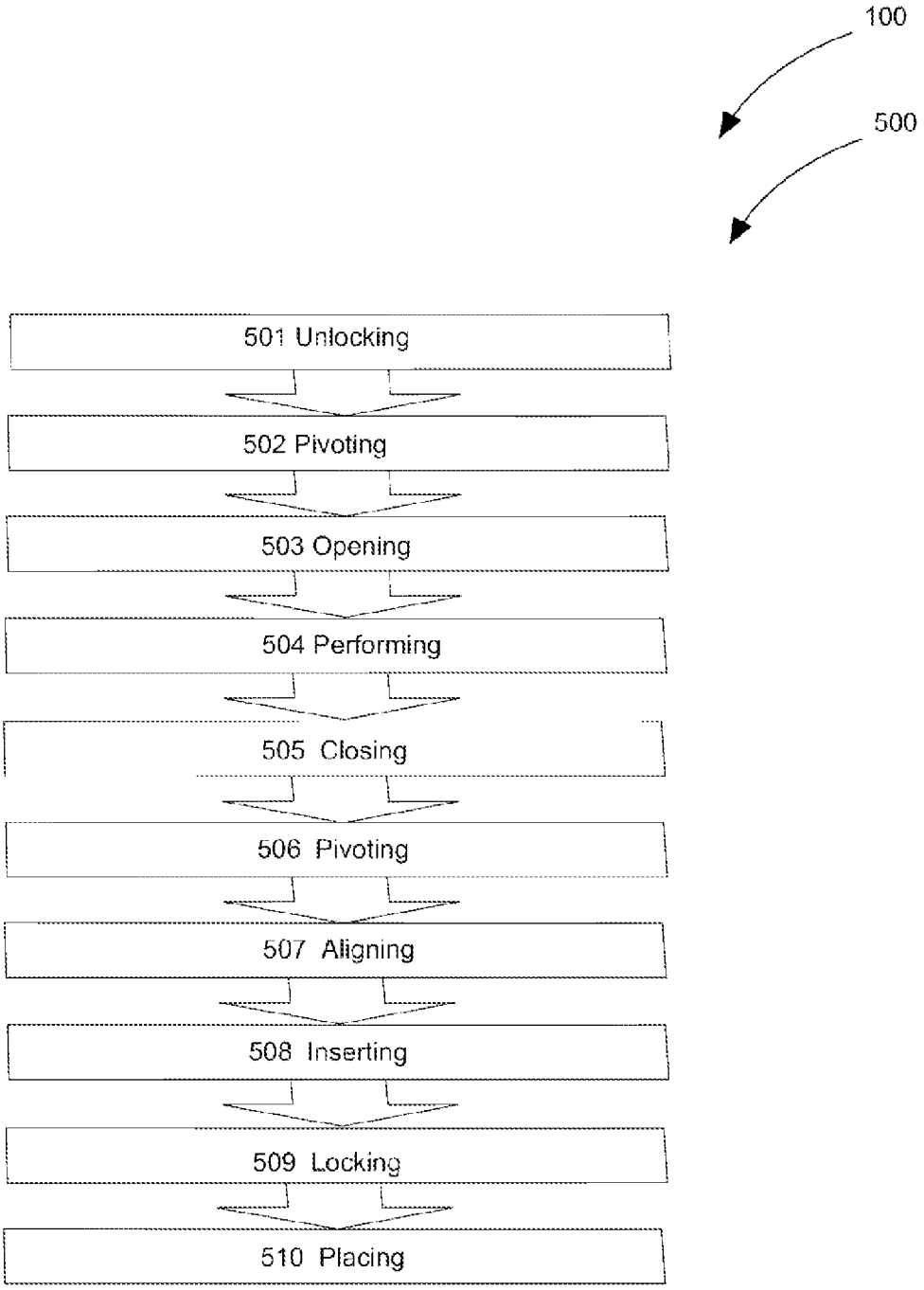
FIG. 5 is a flowchart illustrating a method of use for a lock-out tag-out bar system according to an embodiment of the present invention of FIGS. 1-4.

Referring now to FIG. 5, a flowchart illustrating a method of use for lock-out tag-out bar system 100 according to an embodiment of the present invention of FIGS. 1-4.

A method of use 500 for lock-out tag-out bar system 100 may comprise the steps of: step one 501 unlocking padlock 108 attached to panel-left-side-L-bracket 180; step two 502 pivoting lock-out-bar 120 from horizontal-position 102 to vertical-position 103 via pivot-pin 160 to enable opening of electrical-panel-door 192; step three 503 opening electrical-panel-door 192; step four 504 performing required tasks; step five 505 closing electrical-panel-door 192; step six 506 pivoting lock-out-bar 120 to horizontal-position 103 via pivot-pin 160; step seven 507 aligning bar-second-end-hole 142 with left-bracket-hole 182; step eight 508 inserting padlock 108 through bar-second-end-hole 142 and left-bracket-hole 182; step nine 509 locking padlock 108; and step ten 510 placing tag-out 197 on electrical-panel 190 to show the date of service and who is authorized to access electrical-panel 190 at some time in the future.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A lock-out tag-out bar system comprising:

an electric panel having;

a back surface, a front surface, a top surface, a bottom surface, a panel-left-side, a panel-right-side, and an electric-panel-door pivotally connected to a portion of said front surface and removably covering a front surface access opening of said electric panel;

wherein said back surface, said front surface, said top surface, said bottom surface, said panel-left-side, said panel-right-side, and said electric-panel-door together form a rectangular volume having an interior space therein; and wherein said panel-left-side and said panel-right-side respectively include a plurality of panel-holes;

a lock-out-tag-out-bar-assembly comprising;

a lock-out-bar having;

a first-end; and a second-end;

a pivot-pin;

a panel-right-side-L-bracket; and a panel-left-side-L-bracket;

and a plurality of fasteners adapted to securely and releasably attach said panel-right-side-L-bracket to said panel-right-side via said panel-holes, and said panel-left-side-L-bracket to said panel-left-side via said panel-holes;

wherein said first-end of said lock-out-bar comprises a bar-first-end-hole and said second-end of said lock-out-bar comprises a bar-second-end-hole;

wherein said panel-right-side-L-bracket comprises a right-bracket-hole and a plurality of right-bracket-fastener-holes;

wherein said panel-left-side-L-bracket comprises a left-bracket-hole and a plurality of left-bracket-fastener-holes;

wherein said pivot-pin is able to couple said panel-right-side-L-bracket to said first-end of said lock-out-bar via said right-bracket-hole on said panel-right-side-L-bracket and said bar-first-end-hole on said first-end of said lock-out-bar;

wherein said lock-out-bar is able to be manipulated via said pivot-pin between a horizontal position to secure said electrical-panel-door in a closed condition and a vertical position allowing said electrical-panel-door to be in an open position;

wherein said second-end of said lock-out-bar is removably coupled to said panel-left-side-L-bracket via placing a locking-means through said bar-second-end-hole of said second-end of said lock-out-bar and through said left-bracket-hole of said panel-left-side-L-bracket;

wherein said lock-out-bar is able to prevent said electrical-panel-door from unauthorized use when in said horizontal-position and freedom of access when in said vertical position; and wherein a user is able secure said electrical-panel-door via pivoting said lock-out-bar to said horizontal position via said pivot-pin and removably couple said lock-out-bar to said panel-left-side-L-bracket via placing said locking-means through an alignment of said bar-second-end-hole on said second-end of said lock-out-bar and said left-bracket-hole on said panel-left-side-L-bracket;

wherein said electrical-panel comprises a tag-out for use by a certified electrician, wherein said tag-out includes a surface area for said certified electrician to write on and specify a calendar date to which said lock-out-bar was secured to said electrical-panel-door;

and wherein said tag-out further comprises a do not disturb tag, wherein said do not disturb tag includes a surface area for said certified electrician to write on and indicate a date of last access to said electrical-panel-door and stipulating who is authorized to open said electrical-panel-door;

wherein said lock-out-bar comprises a flat-steel-bar adapted to press against flat surfaces of said panel-right-side-L-bracket, said panel-left-side-L-bracket, and said electric-panel-door, such that when in a closed and locked position said lock-out-bar is positioned tightly and snugly against said flat surfaces and thereby resists tampering;

wherein said right-bracket-fastener-holes are adapted for adjustably attaching said panel-right-side-L-bracket to said panel-right-side via said plurality of fasteners, and wherein a portion of said panel-right-side-L-bracket is adapted to extend perpendicularly from said panel-right-side and away from said front surface;

wherein said left-bracket-fastener-holes are adapted for adjustably attaching said panel-left-side-L-bracket to said panel-left-side via said plurality of fasteners, and wherein a portion of said panel-left-L-bracket is adapted to extend perpendicularly from said panel-left-side and away from said front surface;

wherein said plurality of fasteners comprise carriage-bolts;

wherein one of said carriage-bolts is inserted through one of said plurality of right-bracket-fastener-holes of said panel-right-side-L-bracket and through one of said panel-holes of said panel-right-side to secure said panel-right-side-L-bracket to said panel-right-side using a nut and a washer removably attached to said carriage-bolt;

wherein one of said carriage-bolts is inserted through one of said plurality of said left-bracket-fastener-holes of said panel-left-side-L-bracket and through one of said plurality of panel-holes of said panel-left-side to secure said panel-left-side-L-bracket to said panel-left-side using a nut and a washer removably attached to said carriage-bolt;

wherein said pivot-pin has one end that is deformable, such that after said pivot-pin is inserted through said right-bracket-hole and said bar-first-end-hole it is deformed so that it cannot be removed, and thereby prevents vandals from disconnecting said lock-out-bar from said panel-right-side-L-bracket.

2. The lock-out tag-out bar system of claim 1 wherein said lock-out-bar comprises a length of approximately twenty-four inches able to span the width of a standard electrical-panel.

3. The lock-out tag-out bar system of claim 1 wherein said lock-out-bar comprises a width and a depth providing a suitable mass able to withstand attempts of vandalism to gain access to said electrical-panel-door.

4. The lock-out tag-out bar system of claim 1 wherein said right-bracket-hole of said panel-right-side-L-bracket and said bar-first-end-hole of said first-end of said lock-out-bar comprise a diameter sufficient to hold said pivot-pin.

5. The lock-out tag-out bar system of claim 1 wherein said left-bracket-hole of said panel-left-side-L-bracket and said bar-second-end-hole of said second-end of said lock-out-bar comprise a diameter of approximately three-eighths inch sufficient to hold a shank of said locking-means.

6. The lock-out tag-out bar system of claim 5 wherein said locking-means comprises a padlock requiring a key to access said electrical-panel-door.

7. The lock-out tag-out bar system of claim 5 wherein said locking-means comprises a combination-lock requiring authorized users to have a combination to said combination-lock to access said electrical-panel-door.

* * * * *